US006078256A

United States Patent [19]

Gottlieb

[11] Patent Number: 6,078,256

[45] Date of Patent: Jun. 20, 2000

[54] DEAD-BOLT LOCK MONITORING UNIT AND SYSTEM

[75] Inventor: Mark Gottlieb, Annandale, Va.

[73] Assignee: DesignTech International, Inc., Springfield, Va.

[21] Appl. No.: 08/294,913

[22] Filed: Aug. 24, 1994

[51] Int. Cl.[7] ..... E05B 45/06

[52] U.S. Cl. ..... 340/542; 70/149; 70/102; 70/113

[58] Field of Search ..... 340/542; 70/149, 70/112, 99, 113

[56] References Cited

U.S. PATENT DOCUMENTS

| | | | |
|---|---|---|---|
| 3,833,895 | 9/1974 | Fecteau . | |
| 3,851,325 | 11/1974 | Maged | 340/542 |
| 4,178,587 | 12/1979 | Jamison | 340/542 |
| 4,223,301 | 9/1980 | Grimes et al. . | |
| 4,594,580 | 6/1986 | Nelson . | |
| 4,833,449 | 5/1989 | Gaffigan . | |
| 4,903,010 | 2/1990 | Greene . | |
| 4,937,560 | 6/1990 | Nourmand | 340/542 |
| 4,970,494 | 11/1990 | Keely | 340/542 |
| 5,111,184 | 5/1992 | Heaton | 340/542 |
| 5,311,168 | 5/1994 | Pease | 340/542 |
| 5,499,014 | 3/1996 | Greenwaldt | 340/545 |

*Primary Examiner*—Michael Horabik
*Assistant Examiner*—Albert K. Wong
*Attorney, Agent, or Firm*—Oblon, Spivak, McClelland, Maier & Neustadt, P.C.

[57] ABSTRACT

A dead-bolt receptacle unit and monitoring system which allows an operator to quickly and efficiently determine a status of a dead-bolt, i.e. whether the dead-bolt is bolted or unbolted. A dead-bolt receiving unit is provided into which a dead-bolt cylinder is inserted. A dead-bolt detecting unit is formed in a dead-bolt receiving unit, and the dead-bolt detecting unit detects a presence of the dead-bolt cylinder in the dead-bolt receiving unit. The dead-bolt detecting unit further outputs a dead-bolt detecting signal which is based on the detected presence of the dead-bolt cylinder and the dead-bolt receiving slot. A central indicator unit receives the dead-bolt detecting signals output by each dead-bolt detecting unit, and provides an indication of the status of each dead-bolt, i.e. whether each dead-bolt is bolted or unbolted. Such a system allows an operator to quickly and easily determine the status of each dead-bolt in a home.

16 Claims, 3 Drawing Sheets

DEAD-BOLT LOCK MONITORING UNIT AND SYSTEM

BACKGROUND OF THE INVENTION

1. Field of the Invention

The present invention is directed to a system which can monitor and provide an indication whether a dead-bolt Lock is bolted or not.

2. Discussion of the Background

Security is quickly becoming a big part of every day life. In particular, the ability to remain secure in one's home is very important to feel secure.

Very often, a person will desire to know whether they have secured their home for the evening. It is often the case that when a person gets ready for bed, they will turn off the lights in their home, get in bed, and then suddenly realize that they are not sure whether they bolted one or all of the doors in their home to a locked position earlier in the evening. Thus, for this person to confirm that they have in fact bolted the doors in their home, they will have to walk to the doors and to visually confirm whether the doors have been bolted or not.

SUMMARY OF THE INVENTION

Accordingly, one object of the present invention is to provide a novel dead-bolt lock unit and dead-bolt monitoring system which has a simple installation and which can provide an indication as to the status of the dead-bolts.

The present invention achieves such an objective by forming a novel dead-bolt receptacle unit such that each dead-bolt receptacle unit includes a dead-bolt receiving slot into which a dead-bolt cylinder is inserted. Each dead-bolt receptacle unit also includes a dead-bolt detecting unit which detects a presence of the dead-bolt cylinder in the dead-bolt receiving slot and which outputs a dead-bolt detecting signal based on the detected presence of the dead-bolt cylinder in the dead-bolt receiving slot.

Furthermore, according to the present invention, a central indicator unit can be provided which receives the dead-bolt detecting signals from each of the dead-bolt detecting units. This central indicator unit can then provide a visual indication or an audio indication of the status of each dead-bolt.

In this way, in utilizing the device of the present invention, an operator can quickly glance at the indicator unit to determine the status of each of the dead-bolts, and to confirm that the dead-bolts are in fact bolted.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1B:
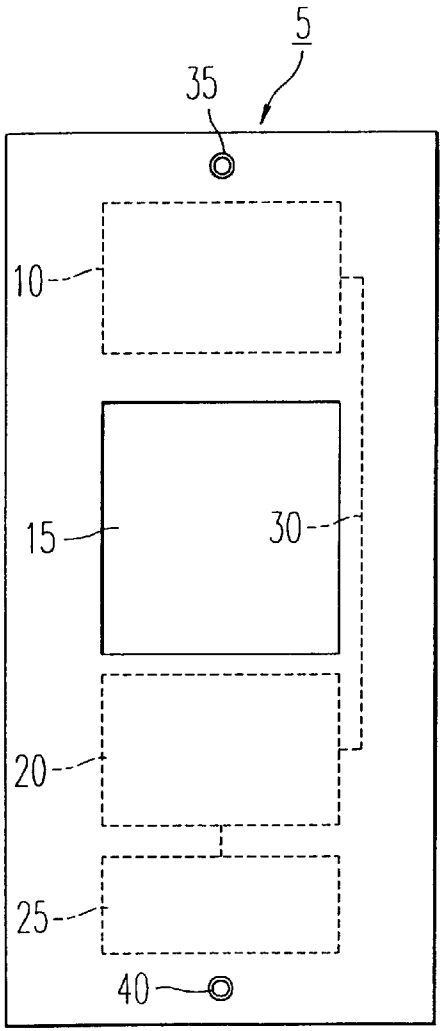
FIGS. 1A and 1B show a first embodiment of the dead-dead-bolt receptacle unit of the present invention.
Figure 1A:
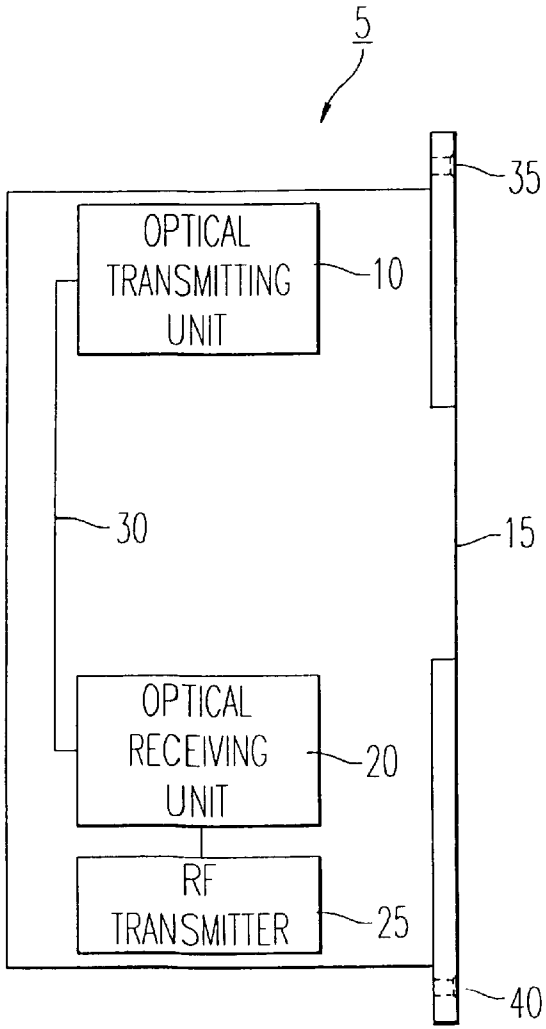

Referring now to the drawings, wherein like reference numerals designate identical or corresponding parts throughout the several views, and more particularly to FIGS. 1A and 1B thereof, there is shown a first embodiment of the dead-bolt receptacle unit of the present invention.

As is shown in FIGS. 1A and 1B, one portion of the present invention is a dead-bolt receptacle unit 5. Such a dead-bolt receptacle unit 5 comprises a slot 15 into which a dead-bolt cylinder (not shown) is inserted, to thereby secure a door. As is shown in FIGS. 1A and 1B, the dead-bolt receptacle unit 5 is screwed into a door frame through screw holes 35 and 40.

As is shown in FIG. 1A showing a side view of the dead-bolt receptacle unit 5 of the present invention, in a first embodiment the dead-bolt receptacle unit 5 of the present invention features an optical transmitting unit 10 formed across from an optical receiving unit 20. This optical receiving unit 20 is then in turn connected to a RF transmitter 25. Further, a power wire 30 may optionally be provided to connect the optical transmitting unit 10 to the optical receiving unit 20.

The operation of the dead-bolt receptacle unit 5 shown in FIG. 1A of the present invention is as follows. The optical transmitting unit 10 transmits a light signal to the optical receiving unit 20. When a dead-bolt cylinder is inserted into the dead-bolt receiving slot 15, the dead-bolt cylinder breaks the optical path of the light signal from the optical transmitting unit 10 to the optical receiving unit 20. This breaking of the optical path is then detected in the optical receiving unit 20, and this in turn causes the RF transmitter 25 to be activated to transmit a signal indicating this change in status in the position of the dead-bolt cylinder.

Figure 2:
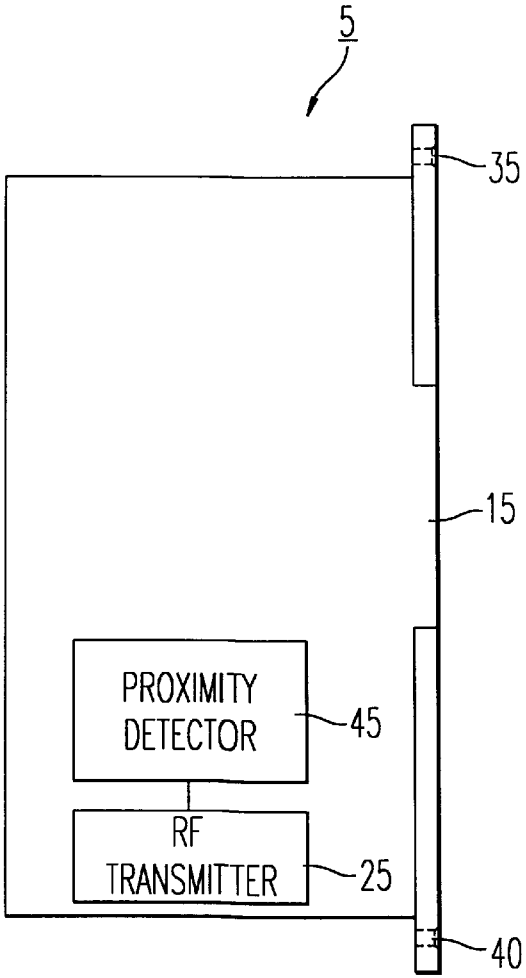
FIG. 2 shows a second embodiment of the dead-bolt receptacle unit of the present invention.

FIG. 2 shows a second embodiment of the dead-bolt receptacle unit of the present invention. In the second embodiment shown in FIG. 2, the optical transmitting unit 10 and optical receiving unit 20 are replaced by a proximity detector 45. Proximity detector 45 is structured to detect when the metal dead-bolt cylinder is placed adjacent thereto. When the proximity detector 45 detects the dead-bolt cylinder, then a signal indicating such a detection is provided to RF transmitter 25.

Figure 3:
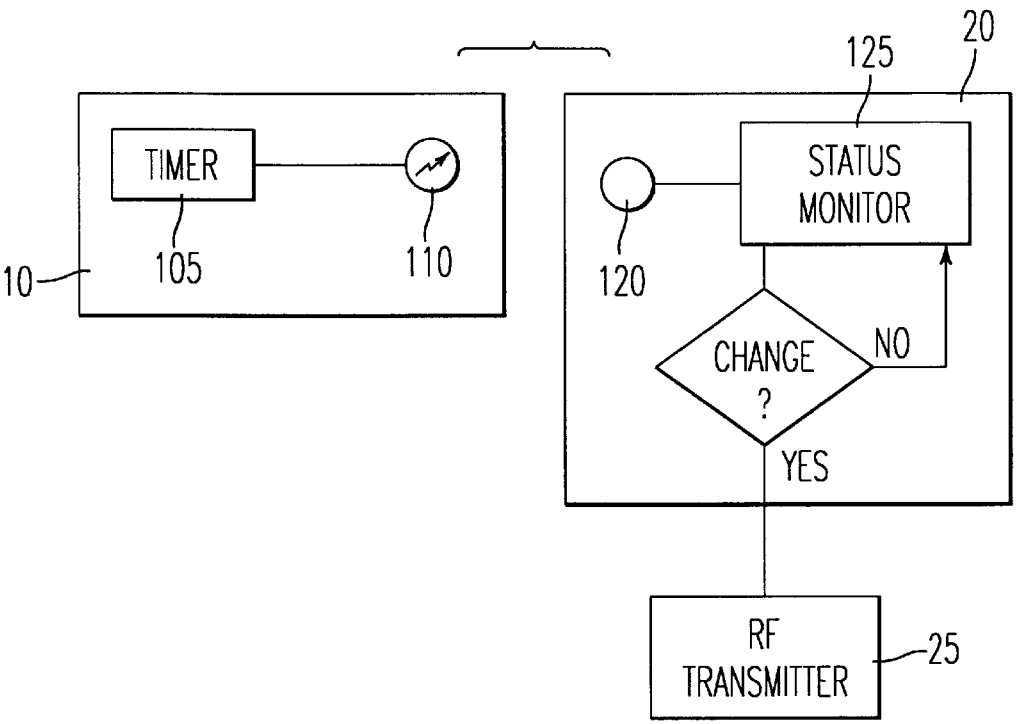
FIG. 3 details the operation of the dead-bolt receptacle unit of the first embodiment of the present invention.

FIG. 3 shows a detailed example of the operation of the optical transmitting unit 10 and optical receiving unit 20 of FIG. 1A. As is shown in FIG. 3, the optical transmitting unit 10 may be formed of a timer 105 and a LED 110. Timer 105 may output a continuous pulse signal to the LED 110. The LED 110 in turn then outputs a pulsed light signal. Optical transmitting unit 10 could also be structured so that a periodic light signal is output.

The optical receiving unit 20 may include an optical photodetector 120 which receives the light signal from the LED 110. In order to conserve the power in the unit of the present invention, the system of the present invention can be operated so that the RF transmitter 25 only transmits a signal when a status change in the position of the dead-bolt cylinder is detected. In such an operation, and as is shown in FIG. 3 of the present specification, the output of the optical photodetector 120 is input into a status monitor 125. The status monitor 125 determines the status of the output of photodetector 120, i.e. the status monitor determines whether the dead-bolt cylinder is inserted in the dead-bolt receiving slot 15 or is not inserted in the dead-bolt receiving slot 15.

The output of the status monitor 125 is input into a change stage 130, whereby it is determined whether the status of the position of the dead-bolt cylinder has changed. If there is no change in the status of the dead-bolt cylinder, i.e., NO in step 130, the optical receiving unit 20 again monitors the status of the signal output from photodetector 120 in status monitor 125.

According to the present invention, when there is a change in the output of the status monitor 125, YES in step 130, then a signal is transmitted by radio frequency transmitter 25 to indicate the status of the position of the dead-bolt cylinder. That is, according to the present invention, if a status change arises, i.e. if the dead-bolt cylinder is either inserted into the receiving slot 15 or is withdrawn from the receiving slot 15, only then is a signal output on RF transmitter 25, and this signal indicates the position of the dead-bolt cylinder. RF transmitter 25 can provide such an indication by transmitting a first coded signal for when the dead-bolt is bolted and a second coded signal for when the dead-bolt is unbolted. A similar operation would also take place if a proximity detector 45 is used, with proximity detector 45 performing similar functions as described above with respect to optical receiving unit 20.

In this way, in this operation of the present invention, the RF transmitter, which is typically the device element which draws the greatest amount of power, is only activated when a position of the dead-bolt cylinder changes, i.e. when the dead-bolt cylinder goes from either bolted to unbolted or unbolted to bolted. This thereby allows power to be conserved in the system of the present invention.

In the embodiment of the present invention shown in FIG. 1A, a connecting wire 30 may connect the optical transmitting unit 10 to the optical receiving unit 20. This connecting wire 30 will typically be a wire to draw power from a battery which may typically be formed in the optical transmitting unit 10. The use of such a connecting wire 30 allows only one battery to be placed in the dead-bolt receptacle unit 5, i.e. it allows the system of the present invention to not require separate batteries in the optical transmitting unit 10 and the optical receiving unit 20. Of course, it is possible to not use wire 30 and to place batteries in each of the elements of the dead-bolt receptacle unit 5 of the present invention.

Figure 4:
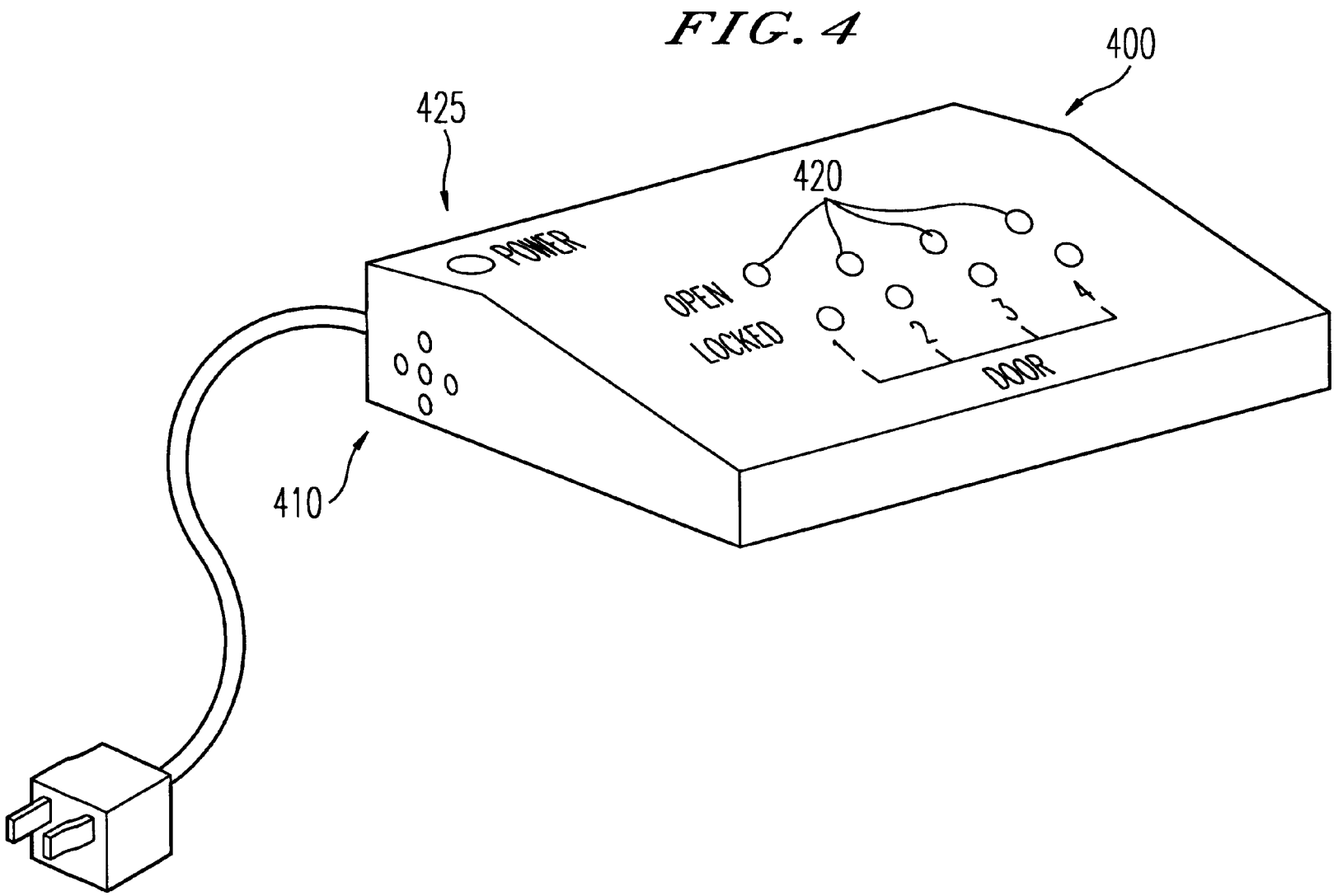
FIG. 4 show one embodiment of the indicator unit of the present invention.

FIG. 4 shows an embodiment of the indicator unit 400 of the present invention. According to the present invention, the indicator unit 400 may comprise a plurality of visual indicators 420, which may conventionally be LED devices. Each of these visual indicators 420 indicates whether a designated dead-bolt cylinder is in an open or a locked position. A power LED 425 also indicates whether the unit 400 is powered. Further, an audio indicator 410 can provide an audio indication whenever a status of any of the dead-bolts changes, i.e. when any of the dead-bolts go from bolted to unbolted or unbolted to bolted.

In the device of the present invention one RF transmitter 25 is placed in each dead-bolt receptacle unit 5. When several doors in a home are being monitored, each RF transmitter 25 in each dead-bolt receptacle unit will transmit a coded signal which contains a unique ID number and code for the bolted/unbolted status, so that thereby a visual indication in the indicator 400 can clearly indicate which doors are in which status condition, i.e. which doors are bolted and which doors are unbolted. This will provide a quick and comprehensive indication of the status of each of the respective doors in a home to an operator.

The present invention has also been described by showing an optical detection system and a proximity detector system for detecting the position of the dead-bolt cylinder. Obviously other detection systems can be employed, and any system which can detect a position of a metal object such as a dead-bolt cylinder can be utilized in the system of the present invention.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A dead-bolt receptacle unit comprising:

a dead-bolt detecting unit formed in the dead-bolt receptacle unit, the dead-bolt detecting unit detecting a presence of the dead-bolt cylinder in the dead-bolt receiving bolt, and generating a non-audible dead-bolt detecting signal based on the detected presence of the dead-bolt cylinder in the dead-bolt receiving slot, wherein the dead-bolt detecting unit comprises an intermittently pulsing light emitting diode and an optical receiver for detecting the presence of the dead-bolt cylinder in the dead-bolt receiving slot.

2. The dead-bolt receptacle unit according to claim 1, wherein the dead-bolt detecting unit further comprises a radio transmitter for transmitting the dead-bolt detecting signal.

3. A dead-bolt receptacle unit comprising:

a dead-bolt detecting unit formed in the dead-bolt receptacle unit, the dead-bolt detecting unit detecting a presence of the dead-bolt cylinder in the dead-bolt receiving bolt, and generating a non-audible dead-bolt detecting signal based on the detected presence of the dead-bolt cylinder in the dead-bolt receiving slot, wherein the dead-bolt cylinder is made of metal and wherein the dead-bolt detecting unit comprises a metal proximity detector for detecting the presence of the dead-bolt cylinder in the dead-bolt receiving slot.

4. The dead-bolt receptacle unit according to claim 3, wherein the dead-bolt detecting unit further comprises a radio transmitter for transmitting the dead-bolt detecting signal.

5. A dead-bolt monitoring system, comprising:

at least one dead-bolt receiving unit into which a respective dead-bolt cylinder is inserted;

a dead-bolt detecting unit formed in each dead-bolt receiving unit, the dead-bolt detecting unit detecting a presence of the respective dead-bolt cylinder in the dead-bolt receiving slot, and generating a respective non-audible dead-bolt signal based on the detected presence of the respective dead-bolt cylinder in the dead-bolt receiving slot; and an indicator receiving the respective dead-bolt detecting signals from each dead-bolt detecting unit and indicating a bolted/unbolted status of the respective dead-bolt cylinders in each of the dead-bolt receiving units.

6. The dead-bolt monitoring system according to claim 5, wherein each dead-bolt detecting unit comprises an intermittently pulsing light emitting diode and an optical receiver for detecting the presence of the dead-bolt cylinder in the dead-bolt receiving slot.

7. The dead-bolt monitoring system according to claim 6, wherein each dead-bolt detecting unit further comprises a radio transmitter for transmitting the respective dead-bolt detecting signal.

8. The dead-bolt monitoring system according to claim 5, wherein the dead-bolt cylinder is made of metal and wherein each dead-bolt detecting unit comprises a metal proximity detector for detecting the presence of the dead-bolt cylinder in the dead-bolt receiving slot.

9. The dead-bolt monitoring system according to claim 8, wherein each dead-bolt detecting unit further comprises a radio transmitter for transmitting the respective dead-bolt detecting signal.

10. The dead-bolt monitoring system according to claim 5, wherein the indicator comprises a separate indicator for each of the respective dead-bolt detecting signals.

11. The dead-bolt monitoring system according to claim 5, wherein the indicator unit comprises an audible indication indicating a change in the presence of any of the respective dead-bolt detecting signals.

12. A dead-bolt monitoring system, comprising:

a plurality of dead-bolt receiving units into which respective dead-bolt cylinders are inserted;

a dead-bolt detecting unit formed in each dead-bolt receiving unit, the dead-bolt detecting unit detecting a presence of the respective dead-bolt cylinder in the dead-bolt receiving slot;

a RF transmitter formed in each dead-bolt receiving unit and connected to receive an output of a respective dead-bolt detecting unit, and for generating a respective dead-bolt detecting signal based on the detected presence of the dead-bolt cylinder in the dead-bolt slot; and an indicator receiving the respective dead-bolt detecting signals from each RF transmitter and indicating a bolted/unbolted status of each of the dead-bolt cylinders in each of the dead-bolt receiving units.

13. The dead-bolt monitoring system according to claim 12, wherein each dead-bolt detecting unit comprises an intermittently pulsing light emitting diode and an optical receiver for detecting the presence of the dead-bolt cylinder in the dead-bolt receiving slot.

14. The dead-bolt monitoring system according to claim 12, wherein each dead-bolt detecting unit comprises a metal proximity detector for detecting the presence of the dead-bolt cylinder in the dead-bolt receiving slot.

15. The dead-bolt monitoring system according to claim 12, wherein the indicator unit comprises a separate indicator for each of the respective dead-bolt detecting signals.

16. The dead-bolt monitoring system according to claim 12, wherein the indicator unit comprises an audible indication indicating a change in presence of any of the respective dead-bolt detecting signals.

* * * * *